United States Patent [19]

Morrison

[11] 4,397,626

[45] Aug. 9, 1983

[54] VIBRATING SCREED AND CURB-FORMING APPARATUS

[76] Inventor: Donald R. Morrison, 6228 Eagle Peak Dr., Charlotte, N.C. 28214

[21] Appl. No.: 251,970

[22] Filed: Apr. 6, 1981

[51] Int. Cl.[3] ..... B28B 1/08

[52] U.S. Cl. ..... 425/64; 404/114; 404/119; 425/456

[58] Field of Search ..... 404/114, 119; 425/456, 425/64; 249/8

[56] References Cited

U.S. PATENT DOCUMENTS

| | | | |
|---|---|---|---|
| 3,224,348 | 12/1965 | Maginniss | 404/114 |
| 3,377,933 | 4/1968 | Dale | 404/119 |
| 3,600,773 | 8/1971 | Davis | 249/8 |
| 4,213,749 | 7/1980 | Morrison | 425/456 |
| 4,261,694 | 4/1981 | Morrison | 425/456 |

*Primary Examiner*—John A. Parrish

*Attorney, Agent, or Firm*—B. B. Olive

[57] ABSTRACT

A lightweight portable concrete screed utilizes an elongated open frame supported on opposed forms and adapted to screed an entire width of concrete formed road and simultaneously form associated curbing on both sides of the road.

5 Claims, 13 Drawing Figures

VIBRATING SCREED AND CURB-FORMING APPARATUS

TECHNICAL FIELD

The invention relates to vibrating screed and associated apparatus for screeding concrete-formed roads, walkways, and the like, and forming associated curbing on both sides of the structure being screeded.

BACKGROUND ART

Lightweight, portable, vibrating, concrete screeds of the type to which the present invention is related are described in applicant's prior U.S. Pat. Nos. 4,030,873; 4,213,749 and 4,253,778. The general state of the art with respect to such type vibrating concrete screeds is believed to be fully set forth in these references and therefore will not be restated.

As another aspect of the prior art, it has been previously known to provide a screeding apparatus which is also adapted to form a curb on one side of the slab being screeded. For example, U.S. Pat. Nos. 3,224,348 and 3,377,933 teach apparatus which is designed to both screed a concrete slab and simultaneously form a curb on one side of the slab being screeded. However, it will be noted that this type of prior art represents an extremely heavy and relatively complex and therefore relatively expensive type of apparatus. As a general observation, so far as applicant is informed, it can be said that there has not been available a lightweight, portable, vibrating-type concrete screed having the ability to screed an entire roadway simultaneously with forming curbing on both sides of the roadway. Thus, it would be desirable to have curb forming apparatus which could be associated with the type of lightweight, portable, vibrating screed taught by applicant's prior patents and which could be utilized to form curbs on both sides of the roadway being screeded and with the ability to form crown and valley-type formations in the roadway contour. The provision of such an apparatus thus becomes the primary object of the present invention. Other objects will become apparent as the description proceeds.

DISCLOSURE OF THE INVENTION

In accordance with the present invention, a portable, lightweight, vibrating concrete screed is provided with detachable curb-forming units which may be attached to the ends of a base frame unit or to the ends of interconnected frame units. Winching mechanisms are also employed.

The base frame unit mounts a drive engine which in turn drives a flexible shaft with mounting arrangements adapted to vibrate the base frame unit throughout its length utilizing any of the various vibrating arrangements disclosed in applicant's prior U.S. Pat. Nos. 4,030,873; 4,213,749 and 4,253,778 by way of example. The curb-forming units of the invention are provided with screed blades which mate with the screed blades of the base frame unit or with the screed blades of any sub-frame unit to which the curb-forming unit of the invention is attached. A turnbuckle arrangement enables the curb-forming unit to be easily and quickly adjusted with respect to the base frame unit or individual sub-frame units to which the curb-forming unit is attached. Thus, the curb-forming units of the invention in combination with the base frame unit or the base frame unit interconnected with other individual sub-frame units may screed in various configurations, such as flat, crowned, or with a valley and the invention curb-forming units may be adjusted accordingly. Winch units may also be employed.

A hopper is provided on each curb-forming unit and which is continuously refilled by operators with concrete materials for forming the curb at each end of the screed corresponding to the sides of the concrete road being formed with the invention apparatus. Each curb-forming unit is also vibrated by means of a shaft incorporated in the curb-forming unit and connected for being driven by the vibrating shaft of the base frame unit. An additional vibrating means is driven off the vibrating shaft for vibrating the material contained within the hopper associated with each curb-forming unit. The shaft also drives winch units.

BEST MODE FOR CARRYING OUT THE INVENTION

Figure 1:
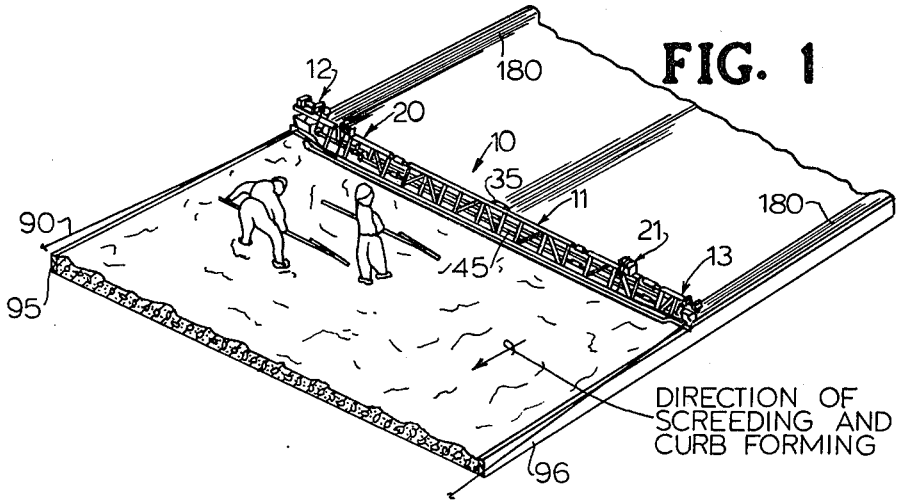
FIG. 1 is an isometric view of a vibrating concrete screed equipped with a pair of curb-forming units at its ends according to the invention and being used in a typical concrete pouring, finishing and curb-forming operation.
Figure 2:
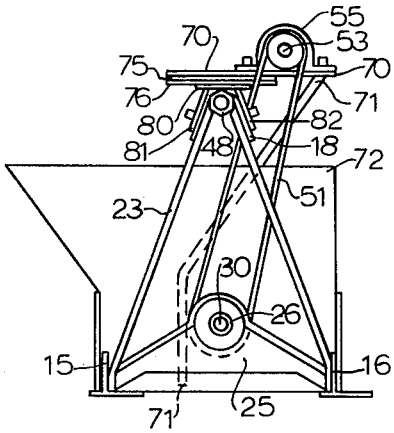
FIG. 2 is an end elevation view of a curb-forming unit taken generally in the direction of line 2—2 in FIG. 1.
Figure 3:
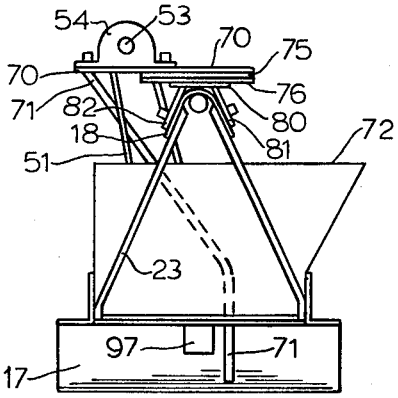
FIG. 3 is an end elevation view similar to FIG. 2 but taken in the direction indicated by line 3—3 of FIG. 1.
Figure 4:
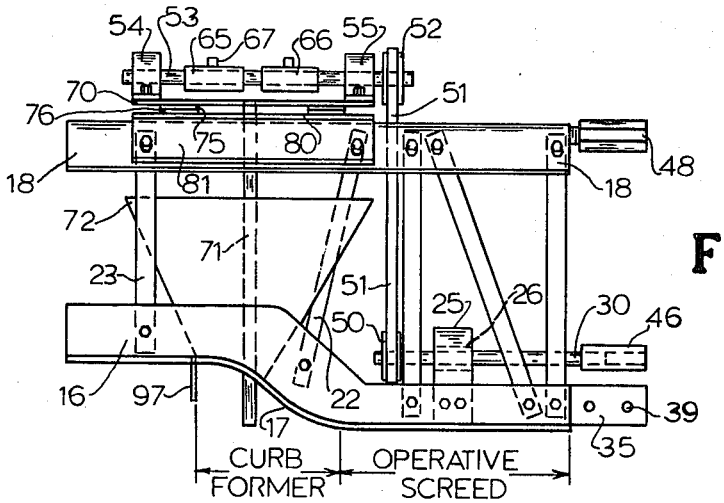
FIG. 4 is a side view looking towards the rear of a curb-forming unit.
Figure 5:
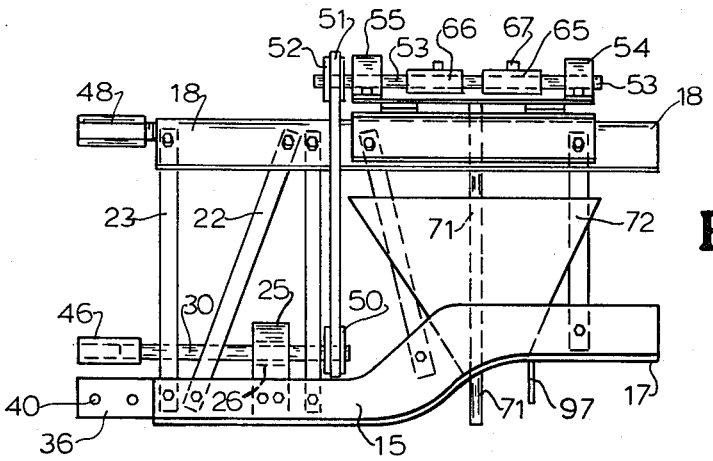
FIG. 5 is a side view looking towards the front of a curb-forming unit.
Figure 6:
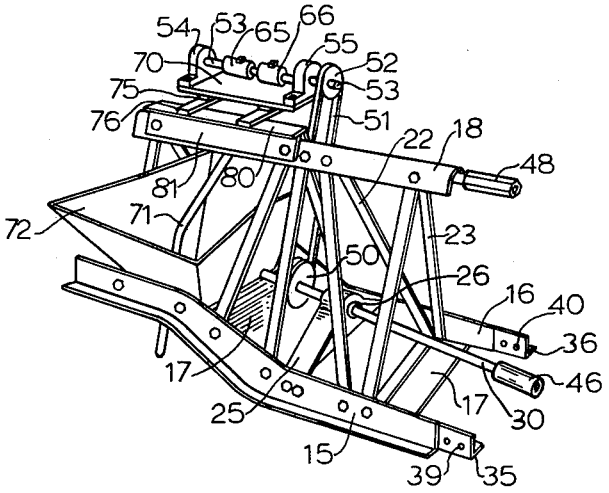
FIG. 6 is a perspective view of a curb-forming unit.
Figure 7:
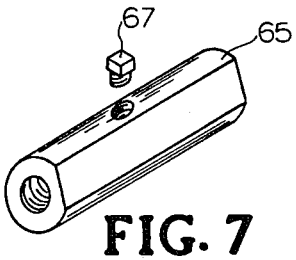
FIG. 7 is a perspective view of a non-uniform sleeve used to establish vibration in the curb-forming unit.
Figure 8:
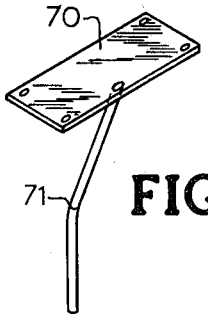
FIG. 8 is a perspective view of a plate and vibrating rod arrangement employed in the curb-forming unit.

The general, elongated open frame construction of the present invention generally follows the construction previously disclosed in applicant's prior U.S. Pat. Nos. 4,030,873; 4,213,749 and 4,253,778 which will hereinafter be referred to simply as "the prior patents". The teachings of the prior patents will be deemed incorporated herein by reference and those details which are fully set forth in the prior patents and which are applicable to the present invention may be understood by making reference to the prior patents and will not be repeated here to simplify the description. As illustrated in FIG. 1, a screed 10 is formed of a base frame unit 11 constructed as previously described in the prior patents, a detachable curb-forming frame unit 12 and a detachable curb-forming frame unit 13 according to the invention. A pair of shaft-powered winching units 20, 21, such as previously described in U.S. Pat. No. 4,253,778, while not required, may also be usefully employed in conjunction with curb-forming units 12, 13. The base frame unit 11, curb-forming units 12, 13 and winch units 20, 21 can be of various lengths and can be easily and quickly connected together, in a manner to be presently described, so as to provide different lengths of screeds for spanning forms of different widths corresponding to roads with curbs and of varying overall width. Units 12, 13, 20 and 21 are typically two and one-half feet in overall length. The individual frame units may be formed of any suitable material but are preferably formed of aluminum to reduce the weight. Since the construction of the base frame unit 11 is fully described in the prior patents, the description will first turn to describing the construction of the left curb-forming frame unit 12 as representing the construction used in both of the curb-forming frame units 12, 13. Each curb-forming frame unit comprises an elongate, open structure frame such as illustrated in FIGS. 2–6. Each such structure frame includes a pair of spaced apart screed plates 15, 16 on the driven end of the curb-forming frame unit and which are illustrated as being inverted T-shaped members for the length L. The bottom screed surfaces provided by screed plates 15, 16 smoothly merge into a double-curved screed plate 17 mounted at the curb-forming end and on the bottom of the curb-forming frame unit and adapted for forming the particular desired shape curb with a "drive over" type curb being used by way of illustration. The screed plates 15, 16 together with curb-forming plate 17 extend for the length of the curb-forming frame unit and are adapted to engage and finish the concrete and form a curb as the screed is moved over the concrete in the direction of the arrow in FIG. 1. Thus, the screed plates 15, 16 and curb-forming plate 17 on each of the curb-forming frame units 12, 13 act as continuations of mating screed plates on the base unit 11. During the forming of the curbs on each side of the road being constructed, the concrete mix is feed through a later-described hopper on the curb-forming unit and through an opening provided in the curb-forming plate 17 such that the end result is to establish formed curbs on each side of the road being constructed.

Here it should be noted that according to the prior patents, the length of the base frame unit 11 was previously extended by attaching detachable screed frame units of the desired additional length. Applicant's prior U.S. Pat. No. 4,253,778 taught such an extension unit provided with a winching mechanism driven from the vibrating shaft of the base frame unit. However, the prior patents did not teach providing a curb-forming mechanism driven from the vibrating shaft as the base frame unit as with the present invention. Thus, with the present invention, the curb-forming frame units can at least partially serve both the screed function of the extension frame units of the prior patents, can be combined with the winch-type extension units of prior U.S. Pat. No. 4,253,778 and most importantly can provide detachable curb-forming mechanism for each end of the base frame unit 11. Thus, a road of substantial width can be screeded over its entire width and simultaneously have curbs formed on both sides and while being winched by winch units 20, 21.

While the open structure frame of the curb-forming frame units of the invention may take various configurations in cross section, the cross section of the curb-forming frame units 12, 13 should, of course, be compatible with the cross section of the base frame unit 11 and is illustrated and is preferably in the form of an isosceles triangle with the screed plates 15, 16 forming the lower corners of the triangle and with the ridge plate 18 forming the apex of the triangle.

The ridge plate 18 extends throughout the length of the curb-forming frame unit and is connected to the screed plates 15, 16 by suitable cross and vertical braces 22, 23. A bridging transverse bearing support 25 is fixed at opposite ends to the screed plates 15, 16 and mounts a bearing 26 which receives in a loose fitting arrangement the vibrating shaft 30 driven by the engine unit 35 which may be mounted and connected as fully described in the prior patents. Also as described in the prior patents, the semi-flexible shaft 45 of the base frame unit 11 also has a loose fit bearing arrangement in the base frame unit 11 so as to impart substantially uniform vibrations throughout the entire length of the base unit 11. The ends of the base frame unit 11 and the respective curb-forming frame units 12, 13 are provided with means for quickly and easily connecting the left and right curb-forming frame units 12, 13 on the ends of the base frame unit 11, or if base frame unit 11 has been previously extended in length to the ends of the extended base frame unit. This arrangement enables the respective screed plates, e.g., screed plates 15, 16, of the curb-forming frame units to act as extensions of the screed plates of the base frame unit 11.

The coupling arrangement is similar to that previously described in the prior patents in that the ends of the screed plates 15, 16 which are to be joined to the screed plates on the frame unit 11, 20 or 21 are provided with angle extensions 35, 36 fixed at their inner ends to the respective screed plates 15, 16 with the outer ends thereof provided with enlarged bolt holes 39, 40 for receiving connecting bolts, or the like. The screed plates of the respective curb-forming frame unit may thus be readily connected to the screed plates of the frame unit 11, 20 or 21. Also, the section of vibrating shaft 30 contained in the respective curb-forming frame unit is connected to the drive shaft 45 of the base frame unit 11 which is driven by the engine 35 through a coupling 46. Another adjustable connecting sleeve 48 joins the ridge plate 18 of the respective curb-forming frame unit to the ridge member of the frame unit 11, 20 or 21. Since the connection arrangement illustrated in FIGS. 2–6 can be generally similar to the connection arrangement illustrated in the prior patents, it is believed that the explanation given will suffice for those skilled in the art.

Referring more specifically to FIGS. 2–6, it will be seen that the short length of drive shaft 20 contained in the curb-forming frame unit 12 mounts a pulley 50 which through a belt 51 drives another pulley 52. Pulley 52 is mounted on a shaft 53 having support bearings 54, 55. Shaft 53 in turn mounts a pair of non-uniform sleeves 65, 66 which serve as eccentric weights secured by screws 67 and which are mounted so as to cause shaft 53 to vibrate when rotated. Support bearings 54, 55 are mounted on a support plate 70 which, through vibration insulating pads 75 and elongated bars 76, is secured to the curb frame unit 12 by means of plate 80 and angle supports 81, 82. Thus, when shaft 53 rotates and is caused to vibrate by means of the eccentric sleeves 65, 66, plate 70 is also caused to vibrate. Plate 70 mounts a vibratory steel rod 71 extending into a concrete mix hopper 72 having an open top and an open bottom extending through an opening provided in the double curved curb-forming plate 17. When shaft 53 rotates and vibrates so as to cause plate 70 to vibrate, rod 71 is in turn caused to vibrate so that any concrete mix placed in the hopper 72 will be vibrated as it works its way downwardly through the open bottom of hopper 72 and through an opening provided in the curb-forming plate 17. Thus, a well-vibrated concrete mix flows downwardly and as screed 10 moves forwardly forms the desired curb formation 180 on both sides of the road 85 under construction. Further, by properly adjusting the relative positions of the eccentric sleeves 65, 66 on the shaft 53, the amount of rod vibration can be increased or decreased according to the consistency of the concrete mix being used and the desired speed of operation. It will be seen then that when the segmental shaft 30 is driven by the main vibrating shaft 45 of the base frame unit 11, rod 71 will be caused to vibrate and by keeping the hopper 72 in both curb-forming units 12, 13 full of the concrete mix, such mix will be continuously vibrated as it passes downwardly through the hopper 72 and through the curb-forming plate 17 so as to form the respective curb formations 180 on both sides of the road 85 being constructed.

While methods of winching other than that illustrated can be employed, screed 10 is preferably provided with the illustrated pair of winching frame units 20, 21 of the type described in prior U.S. Pat. No. 4,253,778. Thus, with such winching frame units, screed 10 of the invention may perform a screeding operation as well as provide a mechanism by which the entire screed can be drawn over the concrete at some predetermined rate and angle and additionally form curbs 180 on both sides of the road 85 being constructed.

Figure 9:
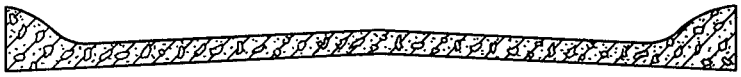
FIG. 9 is a typical cross section of one type of road formed with a crown and a rollover-type curb and which is suited to being formed with the invention.
Figure 10:
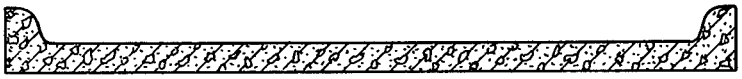
FIG. 10 is a cross section of a flat-type road with another type curb in a form suited to being formed by the invention.

While illustrated in reference to forming a road with a so-called "drive over" type of curb on both sides of the road, it will be appreciated that the curb-forming unit of the invention lends itself to other curb formations and to roads which can be flat, formed with a crown or with a valley. In this regard, FIG. 9 illustrates a typical cross section of a road having a crown effect and with "drive over" type curbs formed on both sides of the road simultaneously while the road itself is being formed with the invention apparatus. FIG. 10 illustrates another typical cross section of a road with a double radius type of curb formation and a flat-type road formation. The invention apparatus of course also lends itself to forming the valley-type road as in FIG. 11 with the angled type of curb formation as further illustrated in FIG. 11.

Using the illustrated winching mechanism 20, 21, the winching cable 90 can be anchored to a "dead man" stake 91 and trained through pulleys 92, 93 at each end of screed 10.

In operation, screed 10 is supported on side forms 95, 96 and end play is reduced by vertical glide plates 97 which slide on the side surfaces of forms 95, 96. The speed and angle of winching can be controlled as fully explained in prior U.S. Pat. No. 4,253,778 and accomplished automatically while the screeding and curb-forming operations take place.

Employment of a rod to vibrate concrete is known as, for example, in prior U.S. Pat. No. 3,472,134. The unique advantage of the present invention in the embodiment disclosed resides, however, in using the engine-driven shaft 45 of base frame 11 to cause the rod vibration as well as winching and overall frame vibration. Therefore, a significant advantage of obtaining well-vibrated concrete curb mixes is assured.

Figure 11:
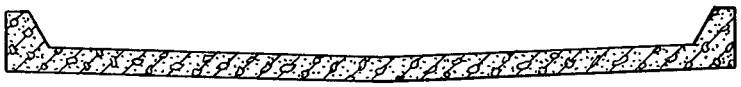
FIG. 11 is a further cross section of a road having a valley and another type curb in a form suited to being made with the invention.
Figure 13:
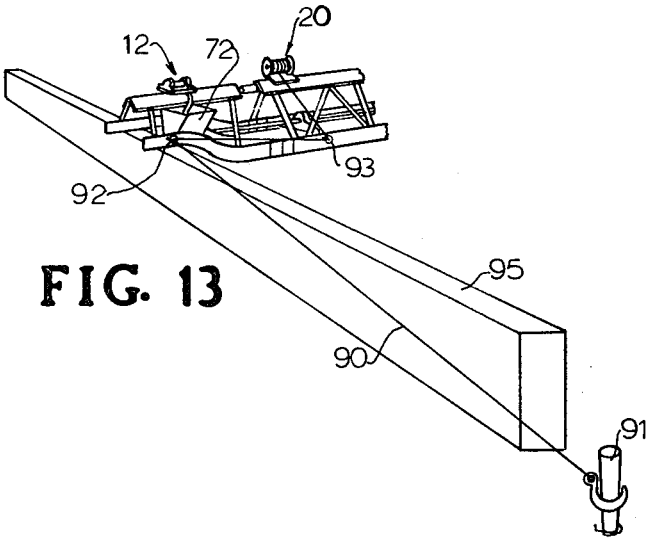
FIG. 13 is a perspective view of the FIG. 12 winching arrangement.
Figure 12:
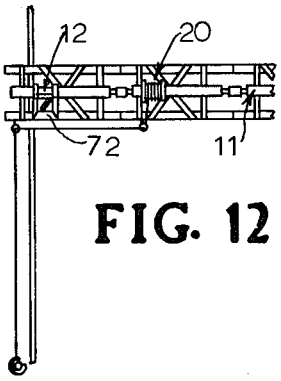
FIG. 12 is a partial plan view of one end of the invention screed and curb-forming apparatus illustrating a method of winching with a shaft-powered winch unit.

In summary, it can be seen that an extremely versatile screed and curb-forming unit has been provided. A particular advantage to the trade is the fact that both curbs can be formed simultaneously with forming the road, walkway, or the like, in which curbs are desired on both sides of the structure being made whether a road, walkway, or the like. By appropriate shaping of the curb-forming plate 17 and its supporting structure, the auxiliary curb-forming unit of the invention can also be quickly adapted to other curb shapes as illustrated by FIGS. 10 and 11.

I claim:

1. A lightweight, portable, concrete speed comprising:

(a) a base screed unit including:

(i) an elongated open frame structure comprising at least one integral frame unit and if more than one a group of interconnected separable integral open frame units and having fixedly mounted on said structure and extending for the length thereof a plurality of parallel, spaced apart screed plates for engaging and leveling concrete as the screed is moved over the concrete;

(ii) a base unit vibrating element comprising a base unit semi-flexible shaft rotatively supported in said frame structure and extending for the length thereof and having means operatively associated with said base unit shaft enabling said base unit shaft when driven to impart vibrations to said frame structure and throughout the length of each of said screed plates; and (iii) drive means mounted intermediate the ends of said base screed unit and connected to drive said base unit shaft to impart said vibrations to said base unit frame structure and said plates; and (b) a pair of lightweight, portable and detachable auxiliary combined screed and curb-forming units, each comprising:

(i) an elongated integral open frame structure adapted to mate the open frame structure of said base screed unit and having fixedly mounted on said auxiliary unit frame structure and extending for the length thereof a plurality of parallel, spaced apart auxiliary screed plates mating those on said base screed unit for engaging and leveling concrete for a portion of the length of the auxiliary unit as an extension of the length engaged and leveled by said base unit screed plates and having operatively associated with said auxiliary screed plates curb-forming plate means for supporting the screed at both ends thereof and for engaging the concrete and for the remaining portion of the length of the auxiliary unit forming a curb as an extension of the length engaged and leveled by said auxiliary screed plates;

(ii) means for detachably connecting adjacent end portions of said base unit and auxiliary unit open frame structures in a predetermined angular relationship;

(iii) a hopper mounted on said auxiliary unit frame structure having an open top and an open bottom extending through said curb-forming means;

(iv) first vibratory means operative in association with said base unit shaft being driven to impart vibrations to said auxiliary unit structure and screed plates; and (v) second vibratory means operative in association with said base unit shaft being driven to cause any concrete mix placed in said hopper to be vibrated during forming of said curb;

whereby when said drive means on said base unit operates and rotates said base unit shaft, said pair of auxiliary combined screed and curb-forming units mounted at the ends of said base unit are enabled to simultaneously level the concrete and form curbs at both ends of said base unit simultaneous with said base unit screeding the concrete therebetween.

2. A lightweight, portable concrete screed as claimed in claim 1 wherein:

(a) said first vibratory means comprises an auxiliary unit semi-flexible shaft detachably connected to said base unit shaft at the junction of said base screed unit and auxiliary unit frame structures and rotatively supported in said auxiliary unit frame structure and extending for the length thereof and adapted to operate as an extension of said base screed unit shaft and having means operatively associated with said auxiliary unit shaft enabling said auxiliary unit shaft to impart vibrations to said auxiliary unit frame structure and throughout the length of said auxiliary unit screed plates when said base unit shaft is rotated by said drive means; and (b) wherein said second vibratory means comprises an auxiliary drive shaft rotatably mounted on said auxiliary unit open frame structure and connected to be driven off said auxiliary unit shaft and including auxiliary vibratory means associated therewith and operable in correspondence with rotation of said auxiliary drive shaft.

3. A concrete screed as claimed in claim 1 wherein said base screed unit includes at each end and inwardly of said pair of auxiliary combined screed and curb-forming units a pair of interconnected winching units of mating construction and having cabling and drive means adapted to be driven off said base unit shaft thereby enabling said base unit together with said winching and screed and curb forming units to be powered by said drive means.

4. A concrete screed as claimed in claim 2 wherein said auxiliary vibratory means associated with said auxiliary drive shaft comprises means mounted on said auxiliary drive shaft to cause said auxiliary drive shaft to vibrate during rotation thereof, a plate supporting said auxiliary drive shaft and a vibratory rod extending downwardly through said hopper and secured to said plate and adapted to be vibrated during rotation of said auxiliary drive shaft through the vibratory effect of said means mounted on said auxiliary drive shaft.

5. A concrete screed as claimed in claim 4 wherein said means mounted on said auxiliary drive shaft comprise non-uniform sleeves adapted for adjustable rotative positioning on said auxiliary drive shaft to vary the amount of vibration caused by rotation of said auxiliary drive shaft and thereby vary the amount of vibration imparted to said rod.

* * * * *